US009381626B2

(12) United States Patent
Profunser et al.

(10) Patent No.: US 9,381,626 B2
(45) Date of Patent: Jul. 5, 2016

(54) HAND-HELD POWER TOOL

(75) Inventors: Dieter Profunser, Feldkirch (AT); Laurent Wahl, Huensdorf (LU)

(73) Assignee: Hilti Aktiengesellschaft, Schaan (LI)

( * ) Notice: Subject to any disclaimer, the term of this patent is extended or adjusted under 35 U.S.C. 154(b) by 1001 days.

(21) Appl. No.: 13/458,775

(22) Filed: Apr. 27, 2012

(65) Prior Publication Data

US 2013/0112448 A1 May 9, 2013

(30) Foreign Application Priority Data

Apr. 28, 2011 (DE) ..... 10 2011 017 671

(51) Int. Cl.
*B25D 11/10* (2006.01)
*B25B 21/02* (2006.01)

(52) U.S. Cl.
CPC ..... *B25B 21/02* (2013.01); *B25B 21/026* (2013.01)

(58) Field of Classification Search
CPC ..... B25D 11/04; B25D 11/066; B25D 11/10; B25B 21/02
USPC ..... 173/93, 93.5–93.7
See application file for complete search history.

(56) References Cited

U.S. PATENT DOCUMENTS

| | | | | |
|---|---|---|---|---|
| 1,505,493 | A * | 8/1924 | Roberts | 173/205 |
| 3,709,306 | A * | 1/1973 | Curington | 173/132 |
| 5,667,283 | A * | 9/1997 | Drennen et al. | 303/115.2 |
| 5,836,403 | A | 11/1998 | Putney et al. | |
| 6,320,286 | B1 | 11/2001 | Ramarathnam | |
| 7,350,592 | B2 * | 4/2008 | Hahn et al. | 173/48 |
| 7,506,693 | B2 * | 3/2009 | Stirm | 173/48 |
| 7,743,847 | B2 * | 6/2010 | Fisher | 173/205 |
| 8,464,805 | B2 * | 6/2013 | Baumann et al. | 173/109 |
| 2003/0019644 | A1 | 1/2003 | Richter et al. | |
| 2004/0184215 | A1 * | 9/2004 | Oh et al. | 361/220 |
| 2005/0199404 | A1 * | 9/2005 | Furuta et al. | 173/48 |
| 2007/0000674 | A1 * | 1/2007 | Sell et al. | 173/48 |
| 2007/0012466 | A1 * | 1/2007 | Sell | 173/48 |
| 2008/0000663 | A1 * | 1/2008 | Sell | 173/93.6 |

(Continued)

FOREIGN PATENT DOCUMENTS

| | | | |
|---|---|---|---|
| CN | 1891408 | A | 1/2007 |
| CN | 101618536 | A | 1/2010 |

(Continued)

OTHER PUBLICATIONS

German Search Report, dated Jan. 23, 2012, 5 pages.

(Continued)

*Primary Examiner* — Gloria R Weeks
(74) *Attorney, Agent, or Firm* — Crowell & Moring LLP

(57) ABSTRACT

A hand-held power tool, in particular in the form of a hammer drill or an impact screwdriver, is disclosed. The tool has a tool receptacle attached to an output shaft for receiving a tool, where the output shaft may be set into a rotating and partially percussive motion by a drive shaft and a tangential striking mechanism. The tangential striking mechanism has an anvil allocated to the output shaft and a hammer allocated to the drive shaft. The hammer can be moved axially under the application of the force of a spring and a sliding block guide, and can be struck against the anvil with the rotation of the same. The sliding block guide has a helical control contour which has a first slope in a first section and a second slope in a second section, where the first and second slopes are different.

13 Claims, 3 Drawing Sheets

(56) References Cited

U.S. PATENT DOCUMENTS

| | | | | |
|---|---|---|---|---|
| 2010/0263890 | A1 | 10/2010 | Profunser et al. | |
| 2010/0276168 | A1* | 11/2010 | Murthy et al. | 173/93.5 |

FOREIGN PATENT DOCUMENTS

| | | | |
|---|---|---|---|
| DE | 101 37 159 | A1 | 2/2003 |
| DE | 10 2009 002 479 | A1 | 10/2010 |
| DE | 10 2009 002 982 | A1 | 11/2010 |
| EP | 0 839 612 | A1 | 5/1996 |
| EP | 1 738 877 | A2 | 1/2007 |
| EP | 2 103 396 | A1 | 9/2009 |
| GB | 693415 | | 7/1953 |
| JP | 2003-181774 | A | 7/2003 |

OTHER PUBLICATIONS

Chinese Office Action dated Jan. 12, 2015, with English-language translation (Ten (10) pages).

* cited by examiner

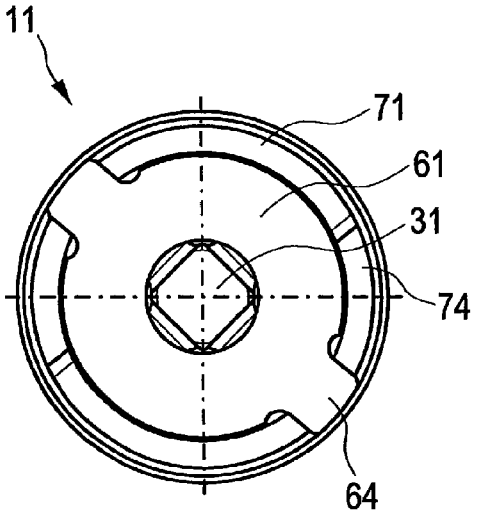
FIG. 3B
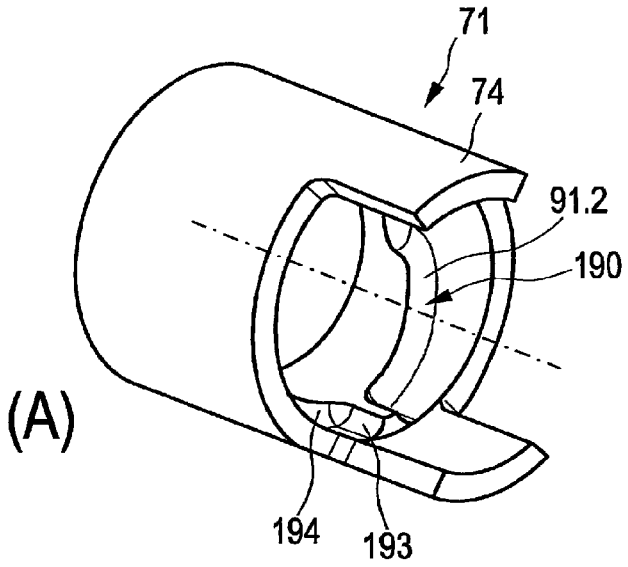
FIG. 4
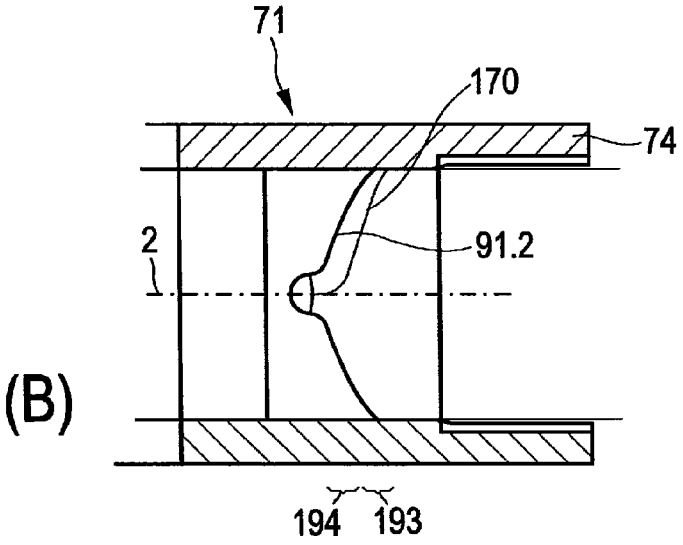

HAND-HELD POWER TOOL

This application claims the priority of German Patent Document No. DE 10 2011 017 671.3, filed Apr. 28, 2011, the disclosure of which is expressly incorporated by reference herein.

BACKGROUND AND SUMMARY OF THE INVENTION

The invention relates to a hand-held power tool. The hand-held power tool may be realized, for example, in the form of a hammer drill or an impact screwdriver. For example, the tangential striking mechanism may generate an impact screwing motion of the output shaft. In that case, the tool may be configured in the form of a screwdriver, which can execute an impact screwing motion in the tool receptacle via the rotating and partially percussive motion of the output shaft. The tangential striking mechanism is normally driven via a motor, if applicable with the interconnection of a gear mechanism. The main components of a tangential striking mechanism structured in a coupling-like manner are a hammer allocated to a drive shaft of the coupling and an anvil allocated to an output shaft of the coupling. The hammer is able to remove itself axially from the anvil against the application of the force of a spring with twisting of the same and subsequently, again with twisting of the same and accelerated under the application of the force of the spring, move percussively against the anvil. The impact motion takes place practically in the tangential direction of the rotational movement. The rotational movement and axial back-and-forth movement for executing a rotary impact are coupled by a sliding block guide so that the hammer is ultimately moved in a restraint-guided manner according to the requirements of the sliding block guide. At a reversal point of the back-and-forth movement, the hammer is triggered by the anvil. At another reversal point of the back-and-forth movement, the hammer executes a rotary impact against the anvil. In this way, the hammer is able, for example, to strike the anvil at every half revolution practically in the tangential direction of the rotational movement and transmit comparatively high torque peaks with the rotary impact. These types of high torque peaks would normally not be achievable with a continuous rotary drive of the output shaft. An aforementioned tangential striking mechanism may be designed as a resonant spring-mass system with a comparatively narrowly defined torque range, within which the actual operating point is established by a drive speed of the drive for the drive shaft. The operating point is also characterized by a triggering moment, at which the hammer decouples from the anvil in the trigger position, i.e., the triggering moment when executing a separation of an engagement of the anvil and of the hammer. In addition, the operating point is characterized by the high torque peak that can be transmitted during the impact. Significant for this are, among other things, the moment of inertia of the hammer, the spring stiffness of the spring and the transmission function of the sliding block guide, which is ultimately specified by a control contour of the sliding block guide.

Within the scope of usual applications, a tangential striking mechanism has a comparatively low triggering moment, which is achieved by means of a comparatively low spring stiffness. A drilling of, for example, deep holes having large diameters that require high torques is only conditionally possible when using such a standard tangential striking mechanism.

It would be desirable to design a tangential striking mechanism also for applications having comparatively high torque requirements. Simply scaling up the design parameters of a standard tangential striking mechanism does not produce the objective in this case, because this regularly goes hand in hand with an increase in the body masses of the tangential striking mechanism. In the case of a power tool of the type cited at the outset, this would result in a deterioration of handling.

The object related to the hand-held power tool is attained by the invention with a hand-held power tool of the type cited at the outset, in which it is provided according to the invention that the sliding block guide have a helical control contour, which has a first slope in a first section and a second slope in a second section, wherein the first and second slopes are different.

It is preferred that a first gradient angle $\alpha$ of the first slope measured in relation to an axis of a cylindrical body for the sliding block guide is greater than a second gradient angle $\beta$ of the second slope measured in relation to the axis. The slopes have in particular the same algebraic sign, i.e., the sections are part of a single helical progression of the control contour.

In an especially preferred further development, it may be provided that the first section forms an anvil-proximal section and the second section forms an anvil-distal section of the control contour and the first slope is greater than the second slope. In particular, the first and the second slopes may be the only essentially different slopes of the control contour. In other words, except for a transition area that is as continuous as possible, there are virtually only the first and second sections having essentially different slopes. The first and second sections are preferably directly adjacent to one another.

The invention proceeds from the consideration that a tangential striking mechanism for a user-friendly and comparatively light-weight hand-held power tool should have a spring system with comparatively low spring stiffness. Proceeding herefrom, it was further recognized that a comparatively high triggering moment is nevertheless achievable if a sliding block guide, especially in a first section in this case that is allocated to the impact, be preferably designed to be suitably steep. It was also recognized that to transmit a comparatively high torque peak with an impact between the hammer and the anvil, a sliding block guide, especially in a second section in this case that is allocated to the triggering of the hammer and the anvil, be preferably designed to be suitably flat. The invention basically recognized that a first section allocated to the impact and a second section allocated to the triggering may be provided with a different first and second slope of a helical control contour.

In contrast to a standard control contour, e.g., a uniform helical control contour applied to a spindle that has a constant slope over the entire progression of the control contour, the idea of the invention provides a sliding block guide with a helical control contour that has a varied slope in an adapted manner. This control contour adapted in the above-mentioned manner has a different slope in a first section allocated to the torque transmission than in a second section allocated to the triggering of the hammer and the anvil. The sliding block guide may preferably also have a control contour basically designed to be V-like, i.e., double helically. However, in contrast to a previously known control contour, this is provided with a single continuously aligned helical progression in a V-leg, which in addition has a first slope in a first section of the V-leg and a second different slope in a second different section of the V-leg, with the slopes having the same algebraic sign.

A comparatively good impact as well as a comparatively high triggering moment may be achieved with a helical control contour of the sliding block guide adapted in this way and this advantageously without the mass of the tangential striking mechanism having to be increased. In particular, a spring stiffness may nevertheless be kept comparatively low.

Additional advantageous further developments of the invention can be found in the dependent claims and provide in detail advantageous possibilities of realizing the concept explained above within the framework of the stated problem as well as with respect to additional advantages.

The anvil is preferably connected to be one piece with the output shaft and the spindle to be one piece with the drive shaft. The sliding block guide is preferably formed on a cylindrical body such as a shaft, e.g., spindle, or a hollow body, for example, on an outer side or an inner side of the cylindrical body. These measures, individually or in combination, produce an especially compact and stable tangential striking mechanism.

The sliding block guide preferably has a first control contour on a spindle between the drive shaft and output shaft. Alternatively, preferably additionally, the sliding block guide has a second control contour on an inner side of the jacket of the hammer. In particular, because of the interplay of the aforementioned first and second control contours in a preferred sliding block guide, an axial and rotating movement of the hammer against the anvil may be realized in order to advantageously execute a rotary impact movement.

With a further development, only the first control contour or only the second control contour of the sliding block guide may respectively have a first section having the first slope and a second section having the second different slope. In a modification, the first control contour and the second control contour of the sliding block guide may respectively have a first section having the first slope and a second section having the second different slope.

The first section preferably forms (in particular respectively) an anvil-proximal section and the second section forms anvil-distal section of the control contour. The first slope is preferably greater than the second slope. In particular, a first gradient angle $\alpha$ of the first slope measured in relation to an axis of a cylindrical body for the sliding block guide is greater than a second gradient angle $\beta$ of the second slope measured in relation to the axis. In an especially advantageous manner, an increased triggering moment can be achieved with the tangential striking mechanism, and the tangential striking mechanism is nevertheless in a position to transmit a comparatively high torque peak, i.e., to execute a good impact. The control contour guarantees an especially secure and loss-free transmission of force in the tangential striking mechanism acting as a coupling. The tangential striking mechanism is also suitable in an especially preferable manner for executing work requiring high torques.

It has proven to be especially advantageous that the first and second slopes are the essentially only different slopes of the control contour and the first and second sections are directly adjacent to one another. This produces a comparatively simple design of the control contour. Basically, beyond this, another section may be provided between the first and second sections, which is provided as a transition section with a gradual adjustment of slope or which has a value that is constant between the first and second slopes.

In an especially advantageous further development, the control contour, preferably a first control contour, is formed by a closed slider of the sliding block guide. In an especially preferred design, a closed slider is configured in the form of a groove (e.g., with a U-shaped cross-section), wherein a sliding block connected in a restraint-guided manner to the hammer can be moved in the groove.

In a further especially advantageous further development, the control contour is formed by an open slider of the sliding block guide. The second control contour is especially preferably formed by an open slider of the sliding block guide. In an especially preferred design, an open slider is configured in the form of a running surface (with a flat cross-section), wherein a sliding block connected in a restraint-guided manner to the hammer can be moved on the running surface.

In an especially preferred further development, which is also explained on the basis of an embodiment, the sliding block guide is formed by an interplay of a closed slider on a spindle between the drive shaft and output shaft and an open slider on an inner side of the jacket of the hammer. Alternatively, the sliding block guide may also be formed by an interplay of a closed slider on an inner side of the jacket of the hammer and an open slider on a spindle between the drive shaft and output shaft. These types of a sliding block guide made of a combination of a closed and an open slider have proven themselves in particular.

Within the framework of an aforementioned especially preferred further development, the control contour is configured in the form of a groove of the running surface, wherein a sliding block can be moved in a restraint-guided manner on the control contour. Basically, the control contour may also be formed inversely thereto, e.g., with a web, on or at which a sliding block is restraint-guided. Basically, a control contour of a sliding block guide for realizing a suitable transmission function may be carried out with two different slopes in a manner adapted to the design requirements.

The first section preferably forms an anvil-proximal section and the second section forms an anvil-distal section of the control contour, wherein the first slope is preferably greater than the second slope. In other words, the first slope allocated to the transmission of the torque peak during the impact is greater than the second slope of the control contour allocated to the triggering of the hammer and the anvil, in particular with a first control contour located on the spindle.

Within the framework of such a further development, it was recognized that a torque peak of a comparatively high amount can be transmitted if the greatest possible portion, in particular the entire rotational energy of the hammer, is transformed into impact energy of the rotary impact (also called tangential impact), i.e., transformed into a torque. This may be supported by a comparatively flat design of the control contour measured in relation to an axis. Within the framework of another further development, it was recognized that a triggering moment between the anvil and the hammer can be designed to be comparatively high. This may also be supported by a comparatively steep design of the control contour measured in relation to an axis.

The first slope preferably increases in the first anvil-proximal section. The increase may be implemented gradually. The first section having a greater slope may also be configured in the form of a first anvil-proximal section having a constant slope, which is greater than the second slope in the second anvil-distal section. The second slope of the control contour is comparatively low. In this case, the progression of the slope in the second section may decrease gradually. However, the second section may also be designed comparatively simply as a section with a constant second slope, which is less than a first slope in the first section. In particular, a progression of the slope in the transition from the first to the second sections may be designed to be gradual or stepped or as a simple stage between the first and second slopes.

In particular, it is provided that, in the engagement position of the anvil and of the hammer for executing a tangential impact, a sliding block connected in a restraint-guided manner to the hammer is disposed in the first section of the control contour. This advantageously rules out that a transmission of a torque peak is limited by a force absorption causing resistance in the second section having a lower second slope. In fact, it is guaranteed that the sliding block facilitates and does not counteract the transmission of the full rotational energy of the hammer as torque on the anvil in the area of the comparatively greater first slope.

The anvil and the hammer are preferably in the complete engagement position to execute a tangential impact. In a reversal point of the back-and-forth movement of the hammer where the rotary impact is executed, the anvil and the hammer have an engagement area, which may be specified, for example, by the length of the impact means. It is preferably provided that the first section especially having a greater slope has an axial extension which makes up at least 20% of the axial extension of the engagement area. This ensures that at least on the remaining 20% of the axial extension of the engagement area, an advantageously greater first slope is present, which permits a transmission of especially high torque peaks. The result during the impact tends to improve, the greater the axial extension of the first section. The axial extension of the section advantageously makes up at least 20% of the axial extension of the engagement area or corresponds approximately to the extension of the engagement area without exceeding it however.

It has also proven to be advantageous that at least in the trigger position of the anvil and of the hammer for executing a separation of an engagement of the same, a sliding block connected in a restraint-guided manner to the hammer is disposed in the second section of the control contour. In this way, it is ensured that the sliding block permits only a high triggering moment in consideration of the lower second slope of the sliding block guide.

An impact means is formed in the case of the anvil and/or hammer preferably in the form of at least one cam. Two cams have proven to be especially advantageous. The cams are advantageously formed on a ring circumference of the anvil and/or the hammer. The ring circumference can be disposed on the head side or laterally from the anvil and/or hammer. The further development having two cams permits, with a suitable adaptation of the control contour, a triggering or tangential impacting of the hammer and the anvil with every half revolution. With a further suitable adaptation of the sliding block guide, more than two cams may be provided, for example in the form of a ring gear. In particular, this may limit a rotational movement to a fractional amount of a full revolution of the hammer.

Within the framework of an especially preferred use of the tangential striking mechanism, a hand-held power tool may be configured in the form of a hammer drill. The tangential striking mechanism is preferably designed to execute the function of a sliding clutch. In this use, the tangential striking mechanism may be preferably operated also out of resonance of the corresponding spring-mass system. The second slope in the second anvil-distal section of the control contour is preferably designed such that the tangential striking mechanism has an especially high triggering moment in order to allow the normal drilling operation of the hammer drill, i.e., not to trigger during the normal drilling operation.

In a modified further development of a use, it has proven to be advantageous to design the hand-held power tool in the form of an impact screwdriver. In the case of this further development, the tangential striking mechanism is designed to execute the function of an impact screwing motion. In this case, it has proven to be especially advantageous for the tangential striking mechanism to be designed for a resonant operation of the spring-mass system connected therewith. This may occur for a defined comparatively limited torque range. In particular, the first slope in the first anvil-proximal section is designed with a comparatively high value in order to achieve an especially high torque peak transmission in the case of a rotary impact between the hammer and the anvil.

An adaptation of the control contour in accordance with the idea of the invention is especially advantageous for the two aforementioned cases of a use. In addition, the aforementioned cases of a use may also be combined with one another by an optimized adaptation of both the first section having a comparatively greater slope as well as the second section having a comparatively lower slope. As a whole, the design of a needs-adapted tangential striking mechanism is possible which permits the transmission of high torque peaks in the case of a rotary impact, on the one hand, and operation with high torque requirements below a triggering moment of the tangential striking mechanism, on the other. In particular, a triggering moment of the tangential striking mechanism may be designed to be comparatively high by increasing the first slope in the first anvil-proximal section so that the tangential striking mechanism behaves practically like a sliding clutch. Nevertheless, a comparatively good torque transmission is guaranteed in the anvil-distal section.

Exemplary embodiments of the invention are described in the following on the basis of the drawings. These drawings are not necessarily supposed to represent the exemplary embodiments to scale, rather the drawings are executed in a schematic and/or slightly distorted form when it is useful for explanatory purposes. Reference is made to the pertinent prior art with respect to additions to the teachings directly identifiable from the drawings. It must be taken into consideration in this case that a wide range of modifications and changes related to the form and detail of an embodiment may be undertaken without deviating from the general idea of the invention. The features of the invention disclosed in the description, the drawings as well as in the claims may be essential for the further development of the invention both separately as well as in any combination. Moreover, all combinations of at least two features disclosed in the description, the drawings and/or the claims fall within the scope of the invention. The general idea of the invention is not restricted to the exact form or detail of the preferred embodiments described and depicted in the following or restricted to a subject matter which would be limited as compared to the subject matter claimed in the claims. In the case of any dimensioning ranges given, values within the stated limits are also meant to be disclosed as limit values, and be applicable at will and claimable.

Additional advantages, features and details of the invention are disclosed in the following description of the preferred exemplary embodiments as well as on the basis of the drawings.

BRIEF DESCRIPTION OF THE DRAWINGS

FIG. 3B is a frontal view of the side view of FIG. 3A (C); and

FIG. 4 view (A) is a perspective view of the hammer for the structural realization of the tangential striking mechanism from FIG. 3A and FIG. 3B and view (B) is a sectional view of the hammer from view (A).

DETAILED DESCRIPTION OF THE DRAWINGS

Figure 1:
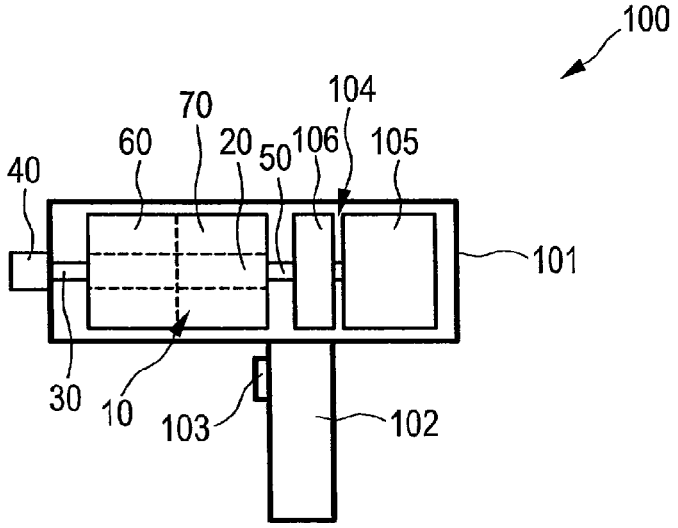
FIG. 1 is a schematic representation of a hand-held power tool having a tangential striking mechanism—in the present case as a hammer drill or an impact screwdriver.

FIG. 1 shows a hand-held power tool 100, e.g., in the form of an impact screwdriver, which can be held by a hand grip 102 formed in a housing 101 and whose drive 104 may be activated in the present case via a trigger 103 in the form of a lever or push button. The drive 104 is formed in this case with a motor 105 in the form of an electric motor, which transmits a rotational movement 1 indicated in FIG. 2 via a gear mechanism 106 and a drive shaft 50 to a spindle 20. The spindle 20 is disposed between the drive shaft 50 and an output shaft 30, and, in the present case, is connected to be one piece with the drive shaft 50. The rotational movement 1 of the spindle 20 is realized via the tangential striking mechanism 10, which is shown in greater detail in FIG. 2, i.e., with the rotary percussive interaction of the hammer 70 and the anvil 60, in a rotating and partially tangentially percussive motion of the drive shaft 50; this rotating and partially percussive motion of the drive shaft 50 (in the tangential direction of the rotational movement) is transmitted to a tool (not shown in greater detail) in a tool receptacle 40 of the hand-held power tool 100.

The tool, e.g., a screwdriver or the like, which is attached in the tool receptacle 40 on the same axis 2 as the spindle 20 and the output shaft 30, is thus in a position to transmit higher torques to a screw, for example, than those that are achievable with the continuous torque performance of the motor 105. The tangential striking mechanism 10 may be modeled within the framework of a spring-mass system. In the present case, it is operated in the resonant range, which optimizes the torque peak transmission to the tool and the screw. A preferred application of a depicted impact screwdriver is, for example, screwing in screws, placing anchors in concrete or a similar hard substrate.

Figure 2:
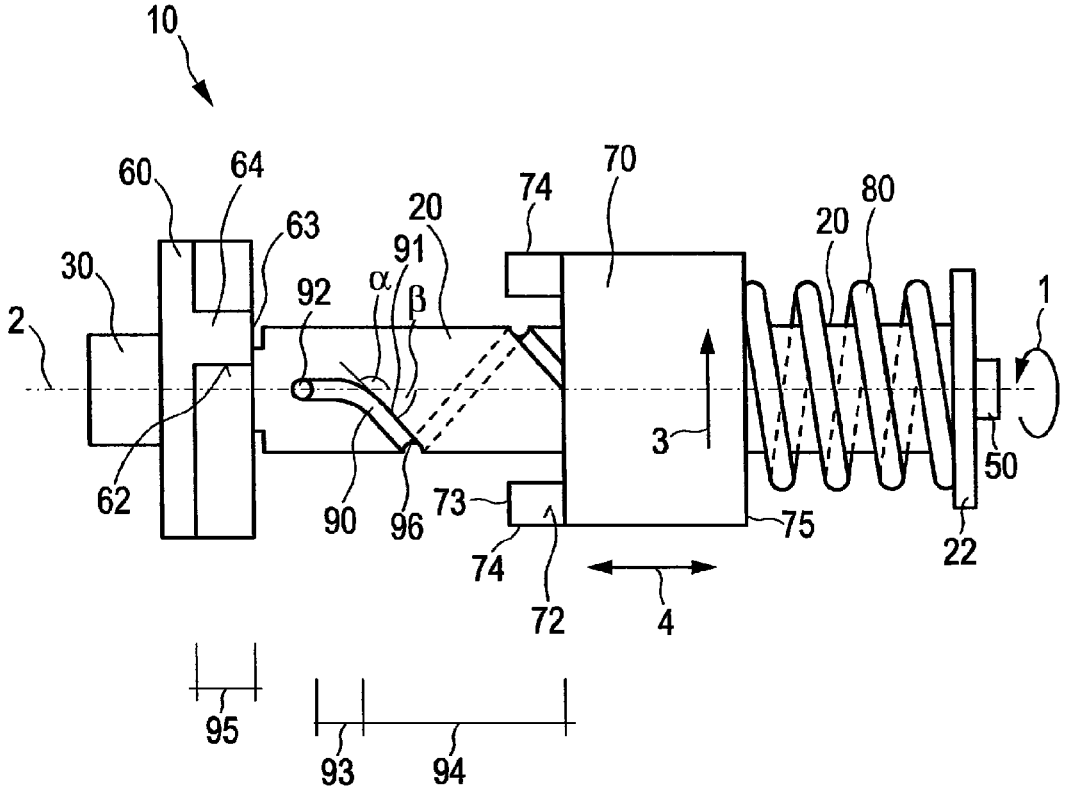
FIG. 2 is a schematic representation of the tangential striking mechanism of the hand-held power tool from FIG. 1, wherein the hammer and the anvil of the tangential striking mechanism are depicted comparatively far apart in a type of exploded view in order to show the progression of the helical control contour of the sliding block guide; to explain the concept of the invention, a sliding block guide is shown with a simple slider of a helical control contour having a first and second slope, which have the same algebraic sign and which have different values.

Making reference to FIG. 2, the tangential striking mechanism 10 has an anvil 60 allocated to the output shaft 30 as well as a hammer 70 allocated to the drive shaft 50. Under the application of the force of a spring 80 and a sliding block guide 90, the hammer 70 in this case may move percussively against the anvil 60 axially with the twisting of the hammer, practically tangential to the rotational direction. The axial movement 4 in the present case is indicated by an arrow as a back-and-forth movement and the rotational movement 3 is indicated by another arrow. A forward reversal point of the axial movement 4 follows the impact of the hammer 70 on the anvil 60 with a rotary impact (also called tangential impact), in which the torque peak is transmitted between the hammer 70 and the anvil 60. A rear reversal point of the axial movement 4 lies on the other side of a triggering location of the hammer 70 and the anvil 60. The triggering location lies approximately in the area of the transition between the first and second sections 93, 94 of the control contour 91, which are explained further below, i.e., approximately in the area of the bend of the control contour 91. In FIG. 2, the hammer 70 is shown far on the other side of the triggering location in order to be able to depict the progression of the sliding block guide 90 more clearly. In this case, the anvil 60 has impact means in the form of two anvil cams 64; in this case, only one anvil cam 64 lying on one side of the anvil is shown.

The lower surface of the anvil cam 64 shown in FIG. 2 serves as an anvil impact surface 62. A corresponding impulse conveyed by the impact of the hammer 70 is exerted on the anvil impact surface 62; a torque peak is thus transmitted by the hammer 70 on the anvil 60. Accordingly, the hammer 70 has two hammer cams 74, wherein the front side of the lower hammer cam 74 shown in FIG. 2 serves as the hammer impact surface 72. This provides an impact on the anvil impact surface 62 for transmitting the cited impulse. In the present case, a transmission of a torque peak to the anvil 60 occurs with every half revolution of the spindle 20. The two anvil cams 64 and two hammer cams 74 are correspondingly designed for this and positioned in coordination with the sliding block guide 90.

The sliding block guide 90 in this case has a closed slider in the form of a groove 96, which is formed in the spindle 20 and follows the only continuous progression of a helical control contour 91. Located in the groove 96 is a sliding block 92 designed as a sphere in this case, via which the hammer 70, which can be moved with a degree of freedom restraint-guided by the sliding block guide 90, sits on the spindle 20 and is connected with the same in a form-fitting manner; namely movable with the execution of the back-and-forth movement in the axial direction 4 and the rotational movement in the tangential direction 3. The anvil impact surfaces 62 and the hammer impact surfaces 72 are aligned in this case perpendicular to the circumferential direction of the anvil 70 or the hammer 60. A vertical line on the anvil impact surface 62 or hammer impact surface 72 thus points in a direction of a tangent on the ring circumference of the anvil 60 comprising the anvil cam 64 or the ring circumference of the hammer 70 comprising the hammer cam 74.

The sliding block guide 90 in this case has a first anvil-proximal section 93 and a second anvil-distal section 94, wherein the first section has a smaller axial extension than the second section 94. The second section 94 directly follows the first section 93. In the first section 93, the control contour 91 has a single helical progression with a first, comparatively steep slope. In the second section 94, the control contour 91 has another single helical progression, which has a second, flatter slope and continues in the same direction as the single helical progression in the first section 93. The second slope having a smaller gradient angle $\beta$ in relation to the axis 2 is thus less than the first slope having a greater gradient angle $\alpha$. In addition, the first section 93 has an axial extension which is somewhat smaller than the axial extension of an engagement area 95 of the anvil 60 and the hammer 70. The engagement area 95 is determined in this case by the axial extension of the impact means, specifically the anvil cam 64 and the hammer cam 74 here.

These proportions of the axial extension of the first section 93 and of the engagement area 95, ensure, for one, that, in the engagement position of the anvil 60 and of the hammer 70, i.e., for executing a tangential impact on the anvil impact surface 62 and the hammer impact surface 72, a sliding block 92 connected in a restraint-guided manner to the hammer 70 is located in the first section 93 of the control contour 91. In addition, the comparatively steep slope of the control contour 91 in the first section 93 ensures a secure engagement of the hammer 70 and the anvil 60. Due to the sufficiently graduated transition of the second slope having a smaller gradient angle β to the first slope having a greater gradient angle α, it is also ensured, in dynamic operation of the tangential striking mechanism 10, that a rotational movement of the hammer 70 shortly before the execution of the tangential impact between the hammer 70 and the anvil 60 in the area of the first, steeper slope of the first section 93 is sufficiently accelerated in the tangential direction for one and, secondly, that the rotational energy may be transmitted as the torque peak.

During the acceleration phase, on the other hand, the force potential of the spring 80 discharges largely in the area of the second section 94 of the control contour 91, and the hammer 70 is pressed forward accelerated in a restraint-guide manner via the sliding block guide 90 and against a mass inertia of the hammer 70. In this way, an especially high valve of a torque peak between the anvil 60 and the hammer 70 is reached in the second section 94 of the control contour 91. In addition, the torque peak is transmitted to the tool in an improved manner in the first section 93 of the control contour 91 and the holding torque is also increased due to the greater gradient angle α at the control contour 91. Thus, a screw, for example, is able to be screwed into a solid substrate more effectively.

Thus, after a rotary impact and a further executed rotational movement 1 of the spindle 20, there remains first of all a coupling between the drive 104 and the tool via the tangential striking mechanism 10 that maintains the torque, because the anvil 60 and the hammer 70 are henceforth engaged on the anvil cam 64 and the hammer cam 74. The engaged state is maintained in an improved way because of the first section 93 of the control contour 91 having a greater gradient angle α.

In the case of increased resistance of the tool against the rotational movement 1, the hammer 70 is pulled out of the engaged state in the engagement area 95 against the spring force of the spring 80, i.e., the spindle 20 is rotated through by the hammer 70 in a restraint-guided manner via the sliding block guide 90. In the process, the hammer 70 remains engaged with the anvil 60 via the hammer cams 74 and the anvil cams 64 until the head sides 63, 73 of the anvil cam 64 or the hammer cam 74 are able to rotate past each other. This occurs practically as soon as the anvil 60 and the hammer 70 have moved further away from each other than the axial extension of the engagement area 95.

The triggering moment of the hammer 70 and the anvil 60 is determined by the first slope of the control contour 91 in accordance with the first gradient angle α. In other words, in the trigger position of the anvil 60 and of the hammer 70 for executing the separation of the engagement of the same, the sliding block 92 connected to the hammer 70 in a restraint-guided manner is situated in the second section 94 of the control contour 91 or switches to it. Due to the gradient angle α of the first slope that is selected to be comparatively great as compared to the gradient angle of the second slope β, the triggering moment is much greater than would be the case with a lower gradient angle. A triggering moment that is thus designed to be comparatively great is present although the spring stiffness of the spring 80 is kept comparatively low in the present case. The comparatively high triggering moment is also achieved without having to increase the overall mass of the tangential striking mechanism 10. Therefore, the tangential striking mechanism 10 facilitates, in an improved way, the operation of the hand-held power tool 100 in the form of an impact screwdriver in the case of applications having comparatively great torques. This also facilitates the use of the tangential striking mechanism 10 in a hammer drill under a load with comparatively great torques, which occurs, for example, when drilling deep holes and/or those with large diameters. In particular, the tangential striking mechanism 10 described in the present case is also suitable as a sliding clutch for a hammer drill or an impact screwdriver, for example. In that case, the first slope having gradient angle α is selected to be so great that a separation of an engagement between the hammer 70 and the anvil 60 virtually does not occur with a normal torque load of the output shaft 30.

After triggering the hammer 70 and the anvil 60, there is a sufficient angular acceleration of the hammer 70 in the second section 94 so that a torque peak transmission is likewise optimized.

Figure 3A:
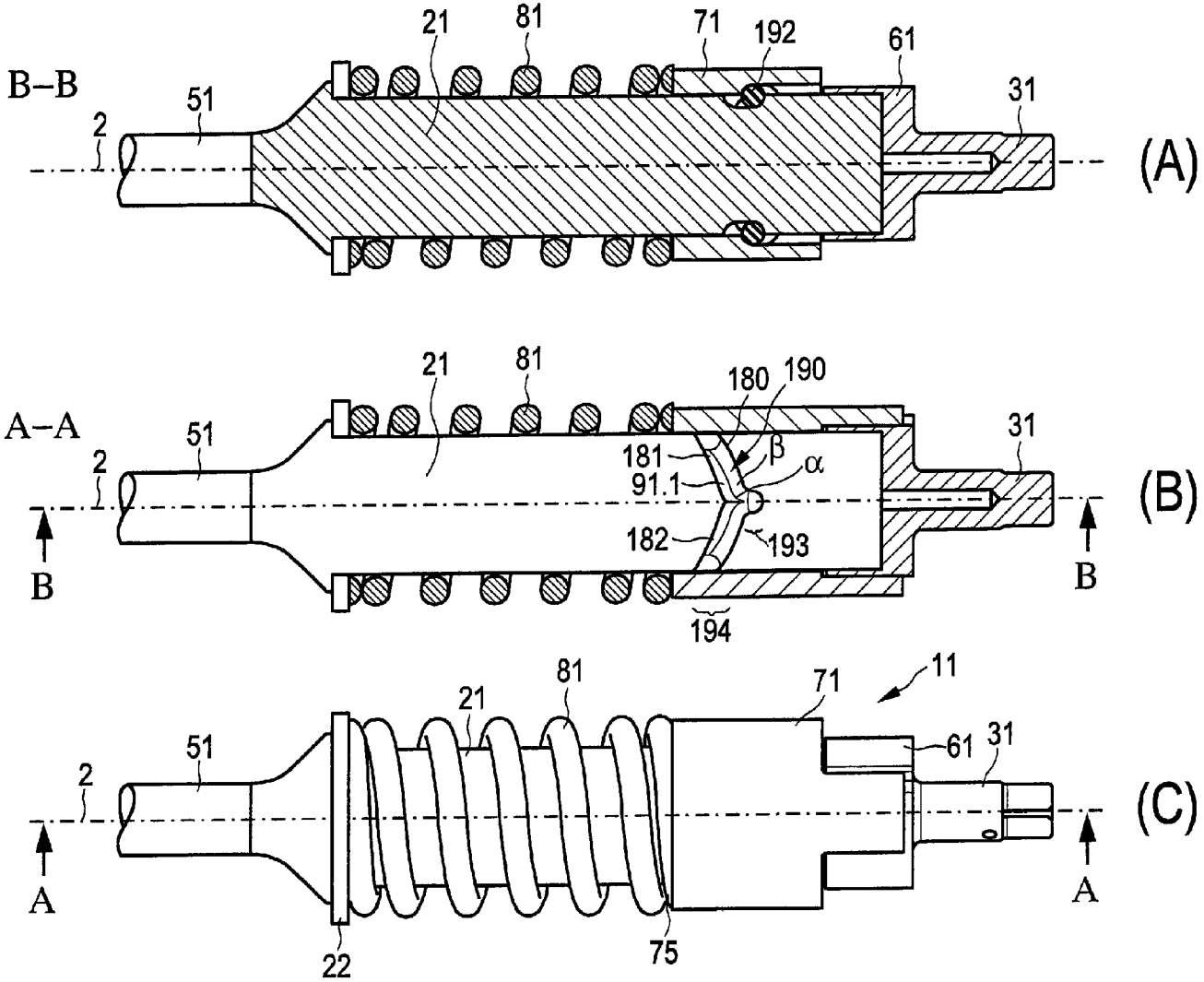
FIG. 3A is a detailed representation of a preferred structural realization of a tangential striking mechanism for an especially preferred embodiment of a hand-held power tool in a lateral view (C) as well as two sectional views (B) and (A) thereof.

Another tangential striking mechanism 11 which is suitable for an especially preferred embodiment of a hand-held power tool 100 shown schematically in FIG. 1 is depicted in a lateral view in FIG. 3A and in a frontal view in FIG. 3B. For this purpose, FIG. 3A and FIG. 3B show a drive shaft 51, which is connected in a rotationally drivable manner (not shown) to a motor 105 of a hand-held power tool 100, for example, via a gear mechanism 106. A tool receptacle 40 or the like for receiving a tool (not shown) of the hand-held power tool 100 may be attached (not shown) at an output shaft 31. FIG. 3A and FIG. 3B show that the output shaft 31 can be set into a rotating and partially percussive motion by means of the drive shaft 51 and a tangential striking mechanism 11; this is basically analogous to the principle explained previously based on FIG. 2. For this, the tangential striking mechanism 11 has an anvil 61 allocated to the output shaft 31 as well as a hammer 71 allocated to the drive shaft 51. In this case, the hammer 71 and the anvil 61 cooperate in principle in the manner basically already described based on FIG. 2.

In the structural realization depicted in FIG. 3A and FIG. 3B, the hammer 71 is thus axially movable under the application of the force of a spring 81 and a sliding block guide 190 shown in views (A) and (B) of FIG. 3A and FIG. 4, and when the hammer 71 is twisted, it can be struck against the anvil 61. In the present case, the anvil 61 is connected to be one piece with the output shaft 31. A spindle 21 in the present case is connected to be one piece with the drive shaft 51. The spring 81 sits concentrically on the spindle 21. Overall, the drive shaft 51, the spindle 21, the anvil 61 and the output shaft 31 are each concentrically disposed to the axis 2 to form the tangential striking mechanism 11. The spring 81 and the hammer 71 sit movably on the spindle 21 likewise concentrically to the axis 2. The spring 81 is supported on the side of the drive shaft 51 on an annular stop 22, which sits on a shoulder between the spindle 21 and the drive shaft 51. On sides of the output shaft 31, the spring 81 is supported on a face side 75 of the hammer 71 and prestresses the same or is in a position to move the same in the direction of the axis 2 with the restraint-guidance of the sliding block guide 190. Both the face side 75 and the annular stop 22 for the spring 80 are also depicted schematically in FIG. 2.

The sliding block guide 190 for the preferred structural realization of the tangential striking mechanism 11 will be described further making reference to views (A) and (B) depicting sections A-A and B-B of FIG. 3A and also making reference to FIG. 4. In this case, the sliding block guide 190 has a first control contour 91.1 and a second control contour 91.2. The first control contour 91.1 specifies the progression of a closed slider in the form of a groove 180 in the spindle 21. The groove 180 is introduced helically in the spindle 21 and has a V-shaped progression in principle, which in a top view runs symmetrically to the axis 2, as shown in view (B) of FIG. 3A. A first branch 181 of the V-shaped groove 180 and a second branch 182 of the V-shaped groove 180 are configured in this respect mirror-symmetrically and in principle running homologously. Each of the branches 181, 182 of the V-shaped groove 180 has a first section 193 with a first slope and a second section 194 with a second slope. In the present case and analogous to the principle shown in FIG. 2 of a control contour 91, also in the case of the sliding block guide 190 in the first section 193, the first slope of a control contour 91.1 is greater than a second slope of a control contour 91.1 in the second section 194.

Concretely, also for the sliding block guide 190 in each of the branches 181, 182, a first gradient angle α of the first slope measured in relation to the axis 2 of the spindle 21 for the sliding block guide 190 is greater than a second gradient angle β of the second slope in the second section 194 measured in relation to the axis 2.

In the case of the tangential striking mechanism 11, the first helical control contour 91.1 on the outer surface of the jacket of the spindle 21 is allocated a second control contour 91.2 shown in FIG. 4, which is introduced in an inner side of the jacket of the hammer 71. The second control contour 91.2 specifies the progression of an open slider in the form of a running surface. The second control contour 91.2 also has a first section 193 and second section 194, which are provided with the same reference numbers for the sake of simplicity. In the first section 193, a slope of the second control contour 91.2 measured in relation to the axis 2 is also greater than a slope of the control contour 91.2 in the second section 194. In particular view (B) of FIG. 3A and view (A) of FIG. 4 show that a first slope of the control contours 91.1, 91.2 is so great that in the course of things the control contours 91.1, 91.2 approach a practically paraxial progression to the axis 2. The greatest first gradient angle α in the first section 193 results at the tip of the progression of the control contour, which is V-shaped as a whole, where the first branch 181 and the second branch 182 come together in the top view at the height of the axis 2. In the direction of the lower second slope in section 194, the first slope of the control contour 91.1, 91.2 of the first section 193 crosses over asymptotically into the second slope of the second section 194. Independent of this, the first and second slopes, as they are identified exemplarily by the gradient angles α, β, are the only essentially different slopes of the control contours.

The interplay of the first control contour 91.1 and the second control contour 91.2 is shown best in view (A) of FIG. 3A. The sectional view (A) shows that a sliding block guide 190 with the groove 180 of the spindle 21 as well adjacent to the running surface 170 of the hammer 71 is restraint-guided. In this way, the movement of the hammer 71, on the one hand, and the spindle 21, on the other, relative to each another is established by the progression of the first and second control contours 91.1, 91.2. Similar to the principle already explained based on FIG. 2, the hammer 71 is movable with twisting of the same axially along the axis 2 of the spindle 21 in accordance with the requirements of the sliding block guide 190. The prestressing of the spring 81 is converted in this case into kinetic energy of the hammer 71, which releases it as torque peak during the impact against the anvil 61. For this purpose, the hammer cam 74 and the anvil cam 64 strike each other in the manner depicted in view (B) of FIG. 3A and FIG. 3B.

In the engagement position of the anvil 61 and of the hammer 71 for executing a rotary impact, the sliding block guide 190 connected in a restraint-guided manner to the hammer 71 is located in the area of the steep slope of the control contour 91.1 in the first section 193 and then crosses over into the further first section 193 of the second control contour 91.2 while passing through the tip of the V-shaped control contour. With a further increase of the torque on the spindle 21 by the drive 104 and via the drive shaft 51, the anvil 61 and the hammer 71 ultimately release by the anvil cam 64 and the hammer cam 74 becoming disengaged. For instance in the trigger position reached in this manner, the restraint-guided sliding block 192 crosses over into the second section 194 of the sliding block guide 190, i.e., into the area of the flatter second slope having gradient angle β. Finally, the sliding block 192 further runs through the groove 180 of the sliding block guide 190 on the circumference of the spindle 21 and thus crosses over into the first section 194 of the first branch 181 of the groove 180. The movement of the sliding block 192 is then further carried out on the other side of the spindle 21 in principle in the same manner. Overall, an impact of the hammer 61 and the anvil 71 is thereby executed every half revolution of the spindle 21.

In the present case, due to the flatter slope having the second gradient angle β in the second section 194 of the sliding block guide 190 as well as due to the steeper slope having a first gradient angle α in the first section 193 of the sliding block guide 190, it produces an especially preferred acceleration of the hammer 71, i.e., a temporally coordinated and compact impact with comparatively high torque peak transmission between the hammer 71 and the anvil 61. In addition, because of the steeper slope having a first gradient angle α in the first section 193 of the sliding block guide 190, a comparatively high triggering moment of the hammer 71 against the anvil 61 is achieved. On the other hand, this comparatively high triggering moment can be achieved with a comparatively low spring stiffness of the spring 81 and with a comparatively low mass of the tangential striking mechanism 11.

Expressed simply, the first section 193 of the sliding block guide 190 primarily supports the formation of a comparatively high triggering moment. The second section of the sliding block guide 190 is primarily designed to build up and transmit a comparatively high torque peak between the hammer 71 and the anvil 61.

In order to facilitate a comparatively good impact between the hammer 71 and the anvil 61, the transition between the second section 194 is comparatively narrowly limited. In other words, an extension of the transition area between a first gradient angle α and a second gradient angle β is kept comparatively low as compared to the extension of the sections 194, 193. This is illustrated, as shown in view (B) of FIG. 3A and FIG. 4, in an approximately kink-like transition between the first section 193 and second section 194 of the control contour 91.1 and the second control contour 91.2. At the transition, the hammer 71 is comparatively highly accelerated due to the flatter slope of the control contour 91.1, 91.2.

In the concrete case of gradient angles α, β shown in view (B) of FIG. 3A, they are selected as follows. A first gradient angle α measured in relation to the axis 2 and counterclockwise in the present case is more likely to lie above 135°, i.e., between 135° and 180° in the progression of the first section 193 of the control contour 91.1, 91.2. A second gradient angle β of the second section 194 measured in relation to the axis 2 and counterclockwise is more likely to lie below 135°, i.e., concretely approximately between an angle of 90° to 135° in the area of the second section 194 of the control contour 91.1, 91.2. In addition, it is also understood that the first gradient angle α with the progression of the control contour 91.1, 91.2 to the axis 2 asymptotically approaches the angle 180°. With the transition from the first section 193 to the section 194, the control contour 91.1, 91.2 crosses over from the first gradient angle α to the second gradient angle β.

On the flat portion of the sliding block guide 190 in the transition between the first branch 181 and the second branch 182, the second gradient angle β asymptotically approaches the angle 90°. A comparatively smooth transition of the sliding block 192 between the branches 181, 182 is thereby facilitated on the front and back sides of the spindle 21 respectively and at the tips of the V-shaped progression of a control contour 91.1, 91.2 respectively.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A hand-held power tool, comprising:

a tool receptacle;

an output shaft, wherein the tool receptacle is attached to the output shaft;

a drive shaft;

a cylindrical body disposed between the output shaft and the drive shaft; and a tangential striking mechanism;

wherein the output shaft is rotatable and moveable in a percussive motion by the drive shaft and the tangential striking mechanism;

wherein the tangential striking mechanism has an anvil allocated to the output shaft and a hammer allocated to the drive shaft, wherein the hammer is movable axially by a spring and a sliding block guide and is strikable against the anvil with a rotation of the hammer;

wherein the sliding block guide has a helical control contour with a first slope in a first section and a second slope in a second section, wherein the first slope is different from the second slope;

and wherein the first section is disposed proximal to the anvil, the second section is disposed distal to the anvil and proximal to the hammer, and the first slope is greater than the second slope.

2. The hand-held power tool according to claim 1, wherein the hand-held power tool is a hammer drill or an impact screwdriver.

3. The hand-held power tool according to claim 1, wherein a first gradient angle of the first slope is greater than a second gradient angle of the second slope.

4. The hand-held power tool according to claim 1, wherein the helical control contour includes a closed slider in a form of a groove, wherein a sliding block connected to the hammer is movable in the groove.

5. The hand-held power tool according to claim 1, wherein the helical control contour includes an open slider in a form of a running surface, wherein a sliding block connected to the hammer is movable on the running surface.

6. The hand-held power tool according to claim 1, wherein the first slope and the second slope are essentially the only different slopes of the helical control contour and wherein the first section and the second section are directly adjacent to one another.

7. The hand-held power tool according to claim 1, wherein in an engagement position of the anvil with the hammer, a sliding block connected to the hammer is disposed in the first section of the helical control contour.

8. The hand-held power tool according to claim 1, wherein in a trigger position of the anvil with respect to the hammer, a sliding block connected to the hammer is disposed in the second section of the helical control contour.

9. The hand-held power tool according to claim 1, wherein the anvil and the hammer each have an engagement area facing each other with a respective impact device.

10. The hand-held power tool according to claim 9, wherein the respective impact devices are a cam on a ring circumference of the anvil and the hammer, respectively.

11. The hand-held power tool according to claim 10, wherein the respective impact devices have an impact surface transverse to a circumferential direction.

12. The hand-held power tool according to claim 1, wherein the first section has an axial extension which lies in a range between 0.1 times and 1.0 times of an axial extension of an engagement area of the hammer with the anvil.

13. A hand-held power tool, comprising:

a tool receptacle;

an output shaft coupled to the tool receptacle;

a drive shaft;

a cylindrical body disposed between the output shaft and the drive shaft;

a sliding block guide on the cylindrical body, wherein the sliding block guide has a helical control contour with a first slope in a first section and a second slope in a second section, wherein the first slope is different from the second slope, wherein the first section is disposed proximal to an anvil, wherein the second section is disposed distal to the anvil and proximal to a hammer, and wherein the first slope is greater than the second slope; and a tangential striking mechanism moveable on the sliding block guide.

* * * * *